US011199024B2

(12) United States Patent
Ike et al.

(10) Patent No.: US 11,199,024 B2
(45) Date of Patent: Dec. 14, 2021

(54) KEY ACCESSORY

(71) Applicant: OMRON CORPORATION, Kyoto (JP)

(72) Inventors: Akihiro Ike, Oita (JP); Yasuhiro Yawata, Kanagawa (JP)

(73) Assignee: OMRON CORPORATION, Kyoto (JP)

( * ) Notice: Subject to any disclaimer, the term of this patent is extended or adjusted under 35 U.S.C. 154(b) by 180 days.

(21) Appl. No.: 16/550,863

(22) Filed: Aug. 26, 2019

(65) Prior Publication Data

US 2020/0270901 A1 Aug. 27, 2020

(30) Foreign Application Priority Data

Feb. 26, 2019 (JP) ..... 2019-000680 U

(51) Int. Cl.
*E05B 19/22* (2006.01)

(52) U.S. Cl.
CPC ..... *E05B 19/22* (2013.01)

(58) Field of Classification Search
None
See application file for complete search history.

(56) References Cited

U.S. PATENT DOCUMENTS 1,979,798 A * 11/1934 Glidden ..... E05B 19/00 70/395
3,526,112 A * 9/1970 Herrington ..... E05B 19/00 70/395
4,440,011 A * 4/1984 Klein ..... E05B 19/22 116/200
5,025,426 A * 6/1991 Blumberg ..... E05B 19/22 340/539.1
5,435,160 A * 7/1995 Linsalato ..... E05B 19/22 40/330
5,548,984 A * 8/1996 Miyatsu ..... E05B 19/22 70/276
5,595,080 A * 1/1997 Whinton ..... E05B 19/22 70/395
5,870,917 A * 2/1999 Mahot ..... E05B 19/22 70/408
6,093,980 A * 7/2000 Yamamoto ..... B60R 25/24 307/10.3
6,246,019 B1 * 6/2001 Nakamura ..... H01H 13/702 200/5 R
6,255,957 B1 * 7/2001 Sonderegger ..... E05B 19/22 340/5.32

(Continued)

FOREIGN PATENT DOCUMENTS

JP 2008267111 11/2008

*Primary Examiner* — Chico A Foxx
(74) *Attorney, Agent, or Firm* — Kristina Castellano; Castellano PLLC

(57) ABSTRACT

A key accessory has a low-cost and simple structure and allows a user to easily confirm on the spot that the user has performed locking even in a place where the user has gone out. A key accessory to be attached to surfaces of a holding part of a key includes: a deforming member configured to be deformed by a holding force applied when the user carries out a locking operation with the key; and a restoring member configured to cause the deforming member having a shape after having been deformed by the holding force to restore to its original shape before the deformation.

7 Claims, 3 Drawing Sheets

(56) References Cited

U.S. PATENT DOCUMENTS 6,575,005 B1 * 6/2003 Hunter ..... E05B 19/22 70/395
6,681,609 B1 * 1/2004 Preddey ..... E05B 27/0082 70/495
6,703,919 B2 * 3/2004 Baset ..... B60R 25/2009 307/10.1
6,886,382 B1 * 5/2005 St. Felix ..... E05B 19/22 70/395
6,959,568 B2 * 11/2005 Abeler ..... E05B 19/22 200/224
7,832,565 B2 * 11/2010 Sasaki ..... H01M 50/216 206/703
8,085,125 B2 * 12/2011 Shamlo ..... E05B 19/22 340/5.2
8,359,891 B2 * 1/2013 Fujimoto ..... G07C 9/00944 70/459
8,604,904 B2 * 12/2013 Fujimoto ..... G07C 9/00944 340/5.62
9,297,184 B2 * 3/2016 Lazovski ..... E05B 19/22
10,721,444 B2 * 7/2020 Rabinowitz ..... H04N 7/188
2004/0080403 A1 * 4/2004 Eshel ..... E05B 19/22 340/425.5
2004/0103702 A1 * 6/2004 Abeler ..... H01H 29/20 70/408
2009/0201151 A1 * 8/2009 Levie ..... E05B 19/22 340/540
2010/0108486 A1 * 5/2010 Yoshida ..... H01H 13/85 200/520
2010/0264007 A1 * 10/2010 Jung ..... H01H 13/78 200/516
2011/0100076 A1 * 5/2011 Weinstein ..... E05B 19/22 70/432
2012/0207265 A1 * 8/2012 Weinstein ..... E05B 19/22 377/15
2013/0145802 A1 * 6/2013 Eichenstein ..... E05B 41/00 70/432
2015/0300042 A1 * 10/2015 Lazovski ..... E05B 19/22 70/393
2016/0055991 A1 * 2/2016 Kropf ..... G07C 9/00944 200/5 A
2019/0390479 A1 * 12/2019 Lipka ..... E05B 19/22

* cited by examiner

KEY ACCESSORY

This Nonprovisional application claims priority under 35 U.S.C. § 119 on Utility Model Application No. 2019-000680 filed in Japan on Feb. 26, 2019, the entire contents of which is hereby incorporated by reference.

TECHNICAL FIELD

The present invention relates to a key accessory.

BACKGROUND ART

People sometimes forget whether they have performed locking after going out. In such a case, they feel uneasy since they cannot confirm on the spot that they have performed locking, and sometimes they go back to home to confirm the locking.

Patent Literature 1 suggests a key with a function of displaying locking confirmation by which a state of locking can be confirmed by verifying the position of a spherical body movably arranged inside a gripping part.

CITATION LIST

Patent Literature

[Patent Literature 1] Japanese Patent Application Publication, Tokukai, No. 2008-267111

SUMMARY OF INVENTION

Technical Problem

The key disclosed in Patent Literature 1 includes: a slider which moves with insertion/removal of the key into/from a key hole; a link mechanism which moves with movement of the slider; and a lock slide which controls movement of the spherical body by moving in a manner depending on how the link mechanism is deformed.

Unfortunately, such a complex structure leads to an increased cost and an increased risk of suffering a breakdown such as a malfunction.

An aspect of the present invention has been attained in view of the above circumferences, and it is an object of the present invention to provide a key accessory which has a low-cost and simple structure and allows a user to easily confirm on the spot that the user has performed locking even in a place where the user has gone out.

Solution to Problem

In order to solve the above problem, a key accessory in accordance with an aspect of the present invention is a key accessory to be attached to surfaces of a holding part of a key, the key accessory including: a deforming member configured to be deformed by a holding force applied when the user carries out a locking operation with the key; and a restoring member configured to cause the deforming member having a shape after having been deformed by the holding force to restore to its original shape before the deformation.

According to the above configuration, holding the holding part of the key to perform locking with the key deforms the deforming member. Thus, by visually identifying the shape of the deforming member with a simple structure, the user can easily confirm on the spot that the user has performed locking even in a place where the user has gone out.

In addition, according to the above configuration, it is possible to return the deforming member to its original shape. This allows for repeated use of the key accessory.

Further, the key accessory in accordance with an aspect of the present invention may be configured such that the deforming member has a curved surface, and the deforming member before the deformation is shaped such that the deforming member is bowed outwardly with respect to the surfaces of the holding part of the key, whereas the deforming member after the deformation is shaped such that the deforming member is bowed inwardly with respect to the surfaces of the holding part of the key. According to the above configuration, the simple structure achieves the member which is deformed by a holding force applied when the locking operation is carried out.

Still further, the key accessory in accordance with an aspect of the present invention may be configured such that the deforming member is a metallic member.

According to the above configuration, elasticity of a metal achieves deformation and restoration of the deforming member.

Yet further, the key accessory in accordance with an aspect of the present invention may be configured such that the restoring member transmits, to the deforming member having the shape after the deformation, a pressing force applied by the user to cause the deforming member to restore to its original shape before the deformation. According to the above configuration, it is possible to easily return the deforming member to its original shape. This allows the user to repeatedly use the key accessory to confirm that the user has performed locking.

Further, the key accessory in accordance with an aspect of the present invention may be configured such that the restoring member is composed of a gel material and has a structure in which the pressing force applied by the user is transmitted via the gel material in a form of a force that pushes up the deforming member having an inwardly bowed shape into an outwardly bowed shape. According to the above configuration, with the restoring member of a simple structure, it is possible to easily return the deforming member to its original shape.

Still further, the key accessory in accordance with an aspect of the present invention may be configured such that the restoring member is located between the deforming member and the holding part of the key and has a structure in which the pressing force applied by the user moves the restoring member toward a center of the deforming member, thereby being transmitted to the deforming member in a form of a force that pushes up the deforming member having an inwardly bowed shape into an outwardly bowed shape. According to the above configuration, it is possible to easily return the deforming member to its original shape.

Yet further, the key accessory in accordance with an aspect of the present invention may further include a restoring spring which allows the restoring member to apply a force in a direction away from the center of the deforming member. According to the above configuration, the restoring member moved toward the center returns to its original state by itself. This facilitates repeated use of the key accessory.

Advantageous Effects of Invention

A key accessory in accordance with an aspect of the present invention has a low-cost and simple structure and allows a user to easily confirm on the spot that the user has performed locking even in a place where the user has gone out.

BRIEF DESCRIPTION OF DRAWINGS (a) of FIG. 1 is a plan view schematically illustrating the configuration of a key accessory in accordance with Embodiment 1 of the present invention together with a key, and (b) of FIG. 1 is a cross-sectional view taken along line A-A in (a) of FIG. 1.

Figure 5:
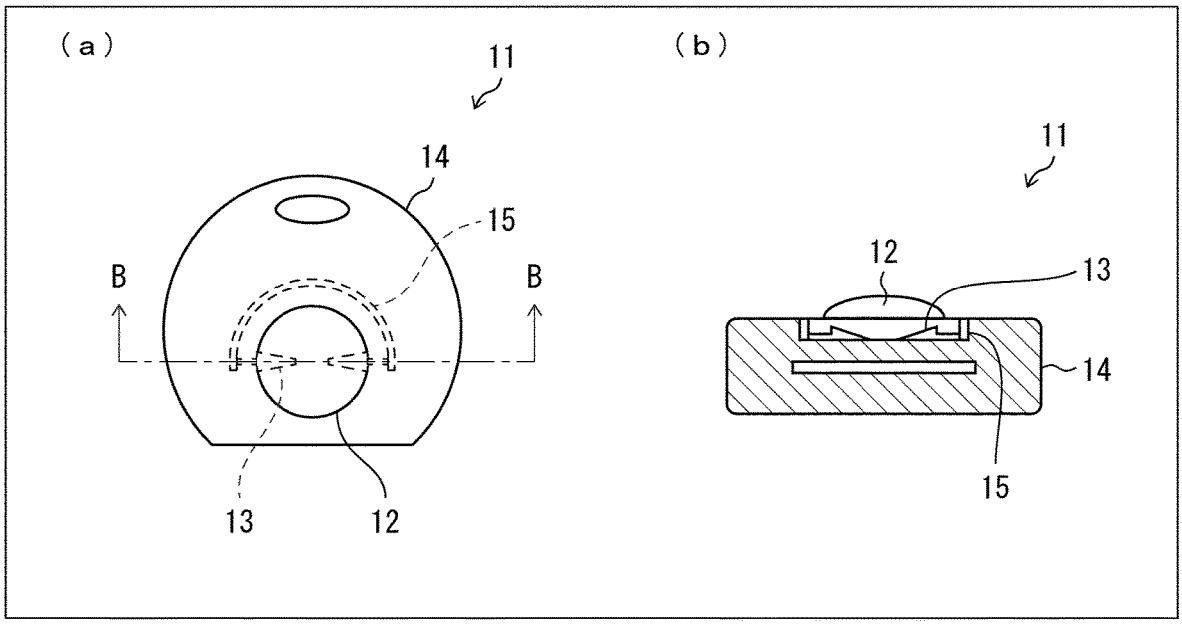

(a) of FIG. 5 is a plan view schematically illustrating the configuration of a key accessory in accordance with Embodiment 2 of the present invention, and (b) of FIG. 5 is a cross-sectional view taken along line B-B in (a) of FIG. 5.

Figure 6:
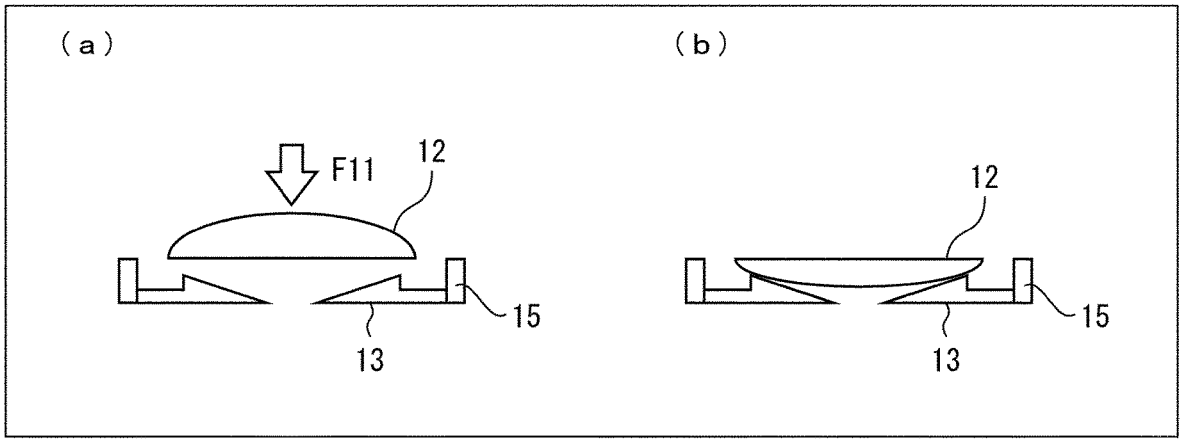

FIG. 6 is a side view schematically illustrating a process of deforming a deforming member in accordance with Embodiment 2 of the present invention, wherein (a) of FIG. 6 illustrates the shape of the deforming member before deformation, and (b) of FIG. 6 illustrates the shape of the deforming member after deformation.

Figure 7:
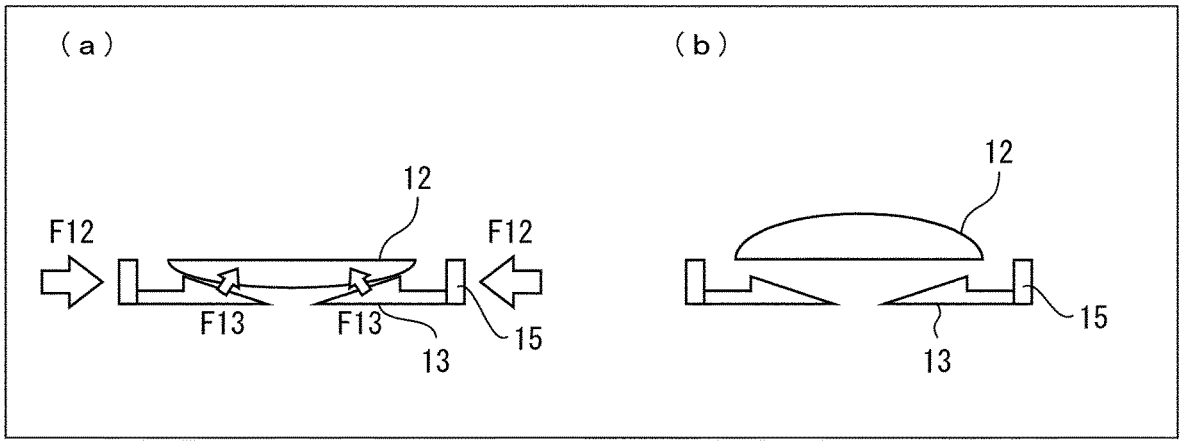

FIG. 7 is a side view schematically illustrating a process of restoring the shape of the deforming member in accordance with Embodiment 2 of the present invention, wherein (a) of FIG. 7 illustrates the shape of the deforming member before restoration, and (b) of FIG. 7 illustrates the shape of the deforming member after restoration.

DESCRIPTION OF EMBODIMENTS

The following will describe embodiments of the present invention (hereinafter each also referred to as "the present embodiment").

Embodiment 1

(Configuration of Key Accessory)

Figure 1:
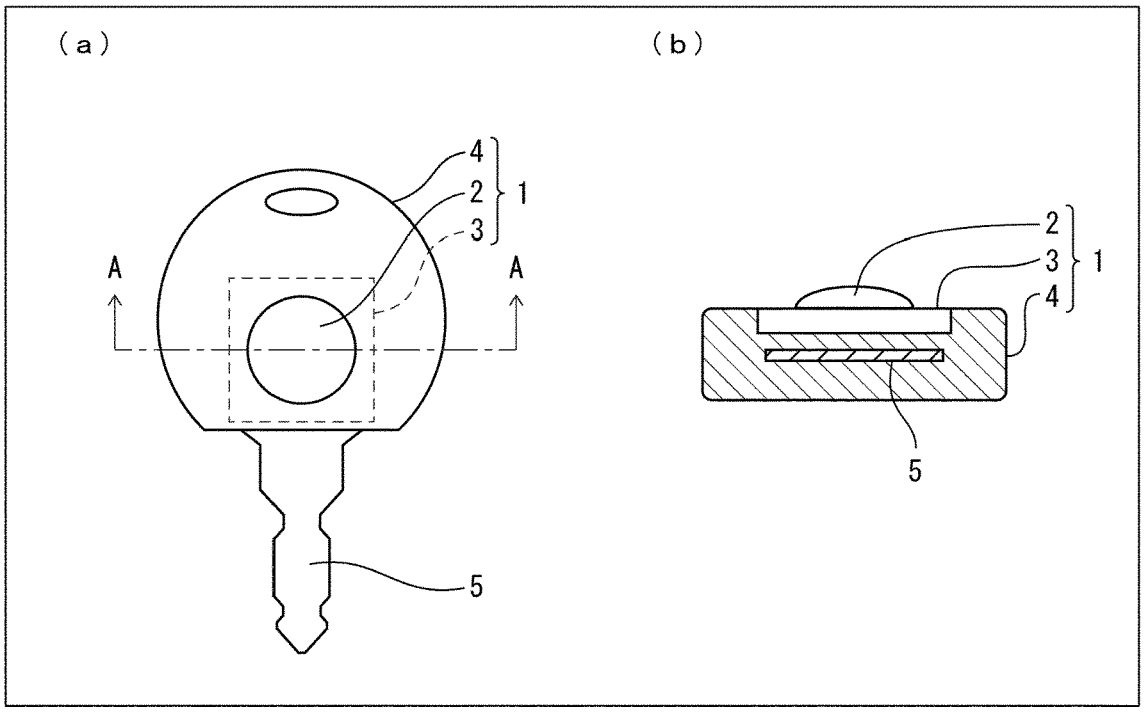

First, the following description will discuss a configuration of a key accessory in accordance with Embodiment 1 of the present invention with reference to FIG. 1. (a) of FIG. 1 is a plan view schematically illustrating the configuration of a key accessory in accordance with Embodiment 1 of the present invention, and (b) of FIG. 1 is a cross-sectional view taken along line A-A in (a) of FIG. 1.

As illustrated in FIG. 1, the key accessory 1 in accordance with the present embodiment includes a deforming member 2, a restoring member 3, and a cover 4. The key accessory 1 is intended to be attached to the surfaces of a holding part of the key 5 so that the deforming member 2 is held by a user when the user carries out a locking operation by using the key 5. More specifically, the key accessory 1, in a state in which the holding part of the key 5 is covered with the key accessory 1, is such that the cover 4, the restoring member 3, and the deforming member 2 are arranged on a first side of the key accessory 1 in the following order: the key 5; the cover 4; the restoring member 3; and the deforming member 2 and are arranged on a second side of the key accessory 1 in the following order: the key 5; and the cover 4. Note that although FIG. 1 illustrates the key accessory 1 configured such that the deforming member 2 and the restoring member 3 are arranged on only one side of the key accessory 1, the configuration of the key accessory 1 in accordance with the present embodiment is not limited to the configuration illustrated in FIG. 1. Alternatively, the key accessory 1 may be configured such that the deforming member 2 and the restoring member 3 are arranged on both sides of the key accessory 1.

The deforming member 2 is configured to be deformed by an externally applied pressure. Specifically, the deforming member 2 is deformed by a holding force applied by the user when the user carries out the locking operation by using the key. Further, the deforming member 2 is configured such that the shape of the deforming member 2 after the deforming member 2 has been deformed by a hold of the deforming member 2 by the user is maintained unless a restoring operation (described later) is carried out. The deforming member 2 has a shape such that the deforming member 2 before deformation has a curved surface which is bowed outward with respect to the surfaces of the holding part of the key 5 and has a shape such that the deforming member 2 after deformation has a curved surface which is bowed inward with respect to the surfaces of the holding part of the key 5. The deforming member 2 deforms such that the curved surface of the deforming member 2 after deformation comes into contact with the restoring member 3. Note that the deforming member 2 in accordance with the present embodiment is constituted by a plate spring, but can be constituted by any member that ensures that the deforming member 2 is deformed by a holding force applied by the user when the user carries out the locking operation with the key and maintains its shape after the deformation. Further, the deforming member 2 in accordance with the present embodiment when viewed from above is in the shape of a disk as illustrated in FIG. 1, but can be in any shape that ensures that the deforming member 2 is deformed by a holding force applied by the user when the user carries out the locking operation with the key and maintains its shape after the deformation. Still further, the deforming member in accordance with the present embodiment is constituted by a metallic member, but can be made of any material that ensures that the deforming member 2 is deformed by a holding force applied by the user when the user carries out the locking operation with the key and maintains its shape after the deformation. A process of deforming the deforming member 2 will be described later.

The restoring member 3 is configured to be subjected to an externally applied pressure and transmit the pressure to the deforming member 2. When subjected to a pressing force applied by the user, the restoring member 3 transmits the pressing force to the deforming member 2 deformed by the holding force applied by the user. The restoring member 3 transmits the pressing force to the deforming member 2 after the deformation to cause the deforming member 2 to restore to its original shape before the deformation. More specifically, the restoring member 3 transmits, to the deforming member 2, the pressing force applied by the user in the form of a force that pushes up the deforming member 2 having an inwardly bowed shape into an outwardly bowed shape. The restoring member 3 in accordance with the present embodiment is composed of a gel material and thus achieves the configuration that ensures that the pressing force applied by the user is transmitted to the deforming member 2. The restoring member 3 in accordance with the present embodiment may be, for example, a vibration pad. However, the configuration of the restoring member 3 in accordance with the present embodiment can be any configuration that ensures that the pressing force applied by the user is transmitted to the deforming member 2. A process of restoring the deforming member 2 to its original shape will be described later.

The cover 4 is configured to serve as a member with which the key accessory 1 is attached to the surfaces of the holding part of the key 5. In the present embodiment, the cover 4 has a structure in which the cover 4 is put on the holding part of the key 5 so that the holding part of the key 5 is covered with the cover 4. On the surface(s) of the cover 4, the deforming member 2 and the restoring member 3 are arranged.

Note that (b) of FIG. 1 illustrates the configuration of the key accessory 1 in which the restoring member 3 is embedded into part of the surface of the cover 4. However, the configuration of the key accessory 1 in accordance with the present embodiment is not limited to the configuration illustrated in (b) of FIG. 1, and can alternatively be such that the cover 4 as a whole is the restoring member 3 or such that the restoring member 3 is arranged on outer surface(s) of the cover 4.

(Process of Deforming the Deforming Member 2)

Figure 2:
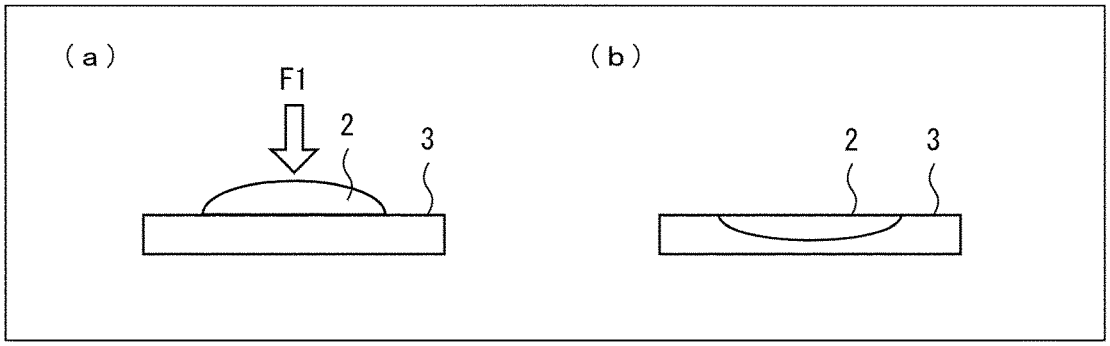
FIG. 2 is a side view schematically illustrating a process of deforming a deforming member in accordance with Embodiment 1 of the present invention, wherein (a) of FIG. 2 illustrates the shape of the deforming member before deformation, and (b) of FIG. 2 illustrates the shape of the deforming member after deformation.

The following will describe a process of deforming the deforming member 2 with reference to FIG. 2.

(a) of FIG. 2 is a side view schematically illustrating the deforming member 2 before deformation, and (b) of FIG. 2 is a side view schematically illustrating the deforming member 2 after deformation. Note that the key 5 is positioned on the opposite side of the restoring member 3 from the deforming member 2.

As illustrated in (a) of FIG. 2, the deforming member 2 before deformation is shaped such that the deforming member 2 is bowed outward with respect to the surfaces of the holding part of the key 5. When the user carries out the locking operation by using the key 5 to which the key accessory 1 is attached, a holding force F1 exerted toward the restoring member 3 by the locking operation is applied to the outwardly curved surface of the deforming member 2. This causes the deforming member 2 to be deformed into a shape such that the deforming member 2 is bowed inward with respect to the surfaces of the holding part of the key 5, as illustrated in (b) of FIG. 2. The deforming member 2 deforms such that the inwardly curved surface of the deforming member 2 after the deformation comes into contact with the restoring member 3.

Thus, locking with use of a key to which the key accessory 1 in accordance with the present embodiment is attached deforms the deforming member 2 of the key accessory 1. Thus, by visually identifying the shape of the deforming member 2, the user can easily confirm on the spot that the user has performed locking even in a place where the user has gone out.

Note that the user can confirm that the user has performed locking by, for example, a method in which the user determines whether the surface of the deforming member 2 is inwardly curved or outwardly curved by touching the surface of the deforming member 2.

Further, the deforming member 2 may be colored and configured to change color such that the color of the deforming member 2 is visually changed in tone between when the deforming member 2 has an inwardly bowed shape and when the deforming member 2 has an outwardly bowed shape. In such a case, when the deforming member 2 has the outwardly bowed shape, the color of the deforming member 2 becomes light in response to expansion of a colored surface of the deforming member 2. When the deforming member 2 has the inwardly bowed shape, the color of the deforming member 2 becomes dark in response to contraction of the colored surface of the deforming member 2. This allows the user to confirm that the user has performed locking by visually identifying the color of the deforming member 2. Note that a translucent cover for protecting the colored surface may be provided over the colored surface.

As another configuration for visually changing tones of color of the deforming member 2, the translucent cover can be configured so as not to move in tandem with the deforming member 2 while being in close contact with the deforming member 2 so that the tones of color of the deforming member 2 visually change by distance between the cover and the deforming member 2. Specifically, the cover is configured so as not to move in tandem with the deforming member 2 while being in close contact with the deforming member 2, so that an internal space is formed between the deforming member 2 and the cover when the deforming member 2 has the inwardly bowed shape. The colored deforming member 2 looks light-colored with decreasing proximity of the deforming member 2 to the cover. While the deforming member 2 has the outwardly bowed shape, the cover and the deforming member 2 are in close contact with each other. With increasing proximity of the deforming member 2 to the cover, the deforming member 2 looks dark-colored. This allows the user to confirm that the user has performed locking by visually identifying the color of the deforming member 2.

(Process of Restoring the Deforming Member 2)

Figure 3:
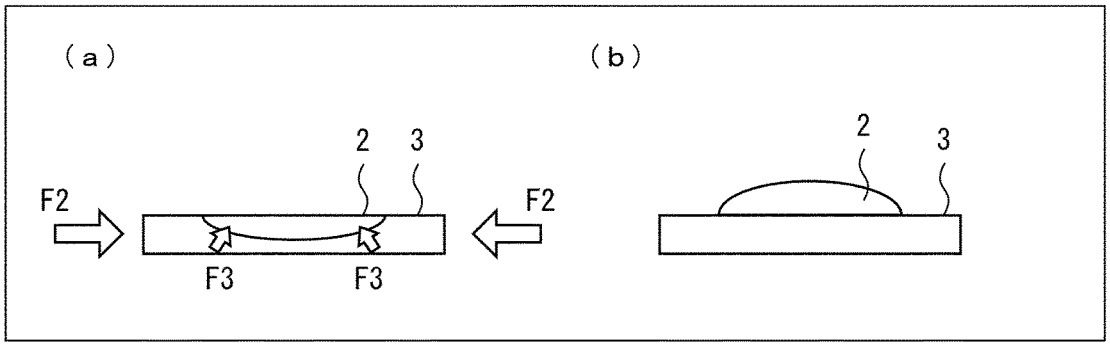
FIG. 3 is a side view schematically illustrating a process of restoring the shape of the deforming member in accordance with Embodiment 1 of the present invention, wherein (a) of FIG. 3 illustrates the shape of the deforming member before restoration, and (b) of FIG. 3 illustrates the shape of the deforming member after restoration.

The following will describe a process of restoring the deforming member 2 with reference to FIG. 3.

(a) of FIG. 3 is a side view schematically illustrating the deforming member 2 before restoration, and (b) of FIG. 3 is a side view schematically illustrating the deforming member 2 after restoration.

As illustrated in (a) of FIG. 3, when the user holds both of side surfaces of the restoring member 3, a pressing force F2 is applied to the restoring member 3 by the user. The restoring member 3 transmits the pressing force F2 applied by the user to the deforming member 2. This applies a pushing-up force F3 to the deforming member 2. The pushing-up force F3 is a force for pushing up the inwardly curved surface of the deforming member 2 having the inwardly bowed shape into the outwardly bowed shape. This restores the deforming member 2 to its original shape before the deformation, as illustrated in (b) of FIG. 3. Further, the restoring member 3, which is composed of a gel material, restores to its original shape by itself after the restoring member 3 is pressed for restoration of the shape of the deforming member 2.

Thus, the key accessory 1 in accordance with the present embodiment is configured such that the deforming member 2 is caused by the restoring member 3 to restore to its original shape before deformation. This allows the key accessory 1 in accordance with the present embodiment to be repeatedly used for confirmation of locking.

(Usage Example of Key Accessory 1)

The following will describe a usage example of the key accessory 1 in accordance with the present embodiment.

<When the User Goes Out>

The user carries out a locking operation by using the key 5 with the holding part covered with the key accessory 1. This makes the deforming member 2 of the key accessory change the outwardly bowed shape into the inwardly bowed shape.

<In a Place where the User has Gone Out>

The user looks at the deforming member 2 of the key accessory 1 to confirm that the user has performed locking. After having confirmed that the user performed locking, the user may apply a pressing force to the restoring member 3 to return the deforming member 2 having the inwardly bowed shape to the outwardly bowed shape or may leave the deforming member 2 as it has the inwardly bowed shape.

<When the User Gets Home>

The user carries out an unlocking operation by using the key 5 with the holding part covered with the key accessory 1. This makes the deforming member 2 change its shape to the inwardly bowed shape even though the user has returned the deforming member 2 to the outwardly bowed shape in a place where the user has gone out. After having carried out the unlocking operation, the user applies a pressing force to the restoring member 3 to return the deforming member 2 having the inwardly bowed shape to the outwardly bowed shape. This allows the user to repeatedly use the key accessory 1 in accordance with the present embodiment to confirm that the user has performed locking.

(Variation)

The description in the present embodiment has dealt with the configuration in which the cover 4 is put on the holding part of the key 5 so that the holding part of the key 5 is covered with the cover 4. However, the configuration of the key accessory 1 in accordance with the present embodiment is not limited to such a configuration. Alternatively, the key accessory 1 in accordance with the present embodiment may be configured such that the holding part of the key 5 is caught by the cover 4 so that the holding part of the key 5 is covered with the cover 4.

Figure 4:
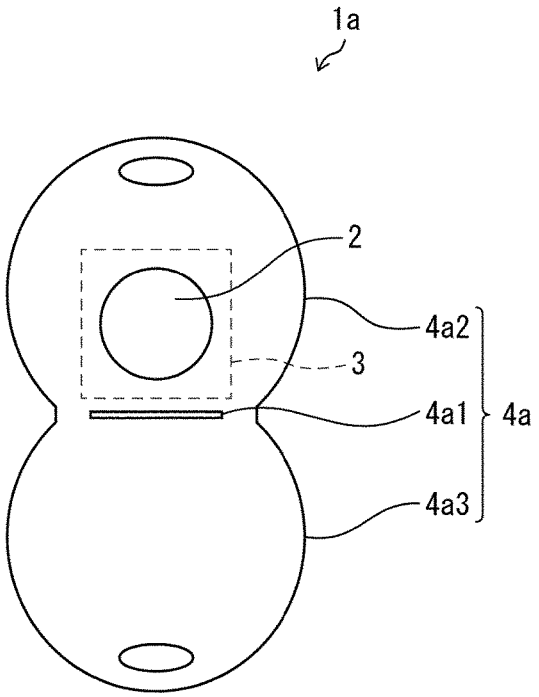
FIG. 4 is a plan view schematically illustrating a variation of the key accessory in accordance with Embodiment 1 of the present invention.

The following will describe a variation in accordance with the present embodiment with reference to FIG. 4.

As illustrated in FIG. 4, a key accessory 1*a* in accordance with the variation is different from the key accessory 1 in accordance with the present embodiment in that the key accessory 1*a* includes a cover 4*a* instead of the cover 4. The cover 4*a* includes an opening 4*a*1 for allowing an inserting part of the key 5 to pass through and sandwiching parts 4*a*2 and 4*a*3 for catching the holding part of the key 5 so that the holding part of the key 5 is covered with the cover 4*a*. The cover 4*a* is used in such a manner that the inserting part of the key 5 is passed through the opening 4*a*1, and then the holding part of the key 5 is caught between the sandwiching parts 4*a*2 and 4*a*3. Consequently, the holding part of the key 5 is covered with the cover 4*a*. Here, the cover 4*a* causes the holding part of the key 5 to be covered therewith in such a manner that the deforming member 2 is placed on a surface (s) of the key accessory 1*a*. More specifically, the cover 4*a* causes the holding part of the key 5 to be covered therewith so that the key 5, the cover 4*a*, the restoring member 3, and the deforming member 2 are arranged in this order in a direction toward one surface of the cover 4*a* on the sandwiching part 4*a*2 side.

Embodiment 2

Next, the following description will discuss a configuration of a key accessory 11 in accordance with Embodiment 2 of the present invention with reference to FIG. 5. (a) of FIG. 5 is a plan view schematically illustrating the configuration of a key accessory in accordance with Embodiment 2 of the present invention, and (b) of FIG. 5 is a cross-sectional view taken along line B-B in (a) of FIG. 5. The key accessory 11 in accordance with the present embodiment is different from the key accessory 1 in accordance with Embodiment 1 in that the key accessory 11 includes restoring members 13 and a restoring spring instead of the restoring member 3. Note that a deforming member 12 and a cover 14 included in the key accessory 11 in accordance with the present embodiment are configured in the same manner as the deforming member 2 and the cover 4 included in the key accessory in accordance with Embodiment 1. Thus, the deforming member 12 and the cover 14 will not be described.

The restoring members 13 are configured to be subjected to an externally applied pressure and transmit the pressure to the deforming member 12. The restoring members 13 each include inclined surfaces which face the deforming member 12 and are inclined with respect to the surfaces of the holding part of the key. The restoring members 13 are configured such that, when the deforming member 12 is deformed into the inwardly bowed shape, the inclined surfaces of the restoring members 13 come into contact with the inwardly curved surface of the deforming member 12. More specifically, the inclined surfaces of the restoring members 13 are arranged such that a distance between the restoring members 13 and the deforming member 12 increases toward the central part of the deforming member 12 from the edges of the deforming member 12. Note that the central part of the deforming member 12 as used herein means a central portion of the deforming member 12 when the deforming member 12 is viewed from above. The restoring members 13 described above are two opposed parts provided along a line passing through the center of the deforming member 12. When subjected to a pressing force applied by the user inwardly from outer ends of the restoring members 13, the restoring members 13 are moved toward the center of the deforming member 12. In the present embodiment, the pressing force is applied via the restoring spring 15 (described later). When the restoring members 13 are moved toward the center of the deforming member 12, the inclined surfaces of the restoring members 13 push up the inwardly curved surface of the deforming member 12 having the inwardly bowed shape to restore the deforming member 12 to its original shape before the deformation. In this way, the restoring members 13 transmit the pressing force to the deforming member 12 after deformation to restore the deforming member 12 to its original shape before the deformation. More specifically, the restoring members 13 transmit, to the deforming member 12, the pressing force applied by the user in the form of a force that pushes up the deforming member 12 having the inwardly bowed shape into the outwardly bowed shape. Note that the forms of the restoring members 13 are not limited to specific forms as long as the restoring members 13 include the above-described inclined surfaces.

The restoring spring 15 is a plate spring shaped in an arc. The restoring members 13 are attached to the arc-shaped restoring spring 15 at positions between both ends of the arc-shaped restoring spring 15. When a pressing force exerted in an inward direction of the arc-shaped restoring spring 15 is applied to the ends of the arc-shaped restoring spring 15 by the user, the arc-shaped restoring spring 15 moves the restoring members 13 toward the center of the deforming member 12. Further, the restoring spring 15 returns to its original position when the pressing force applied by the user is released. This applies, to the restoring members 13, forces in opposite directions away from the center of the deforming member 12. Thus, when the pressing force applied by the user is released, the restoring spring 15 allows the restoring members 13 to return back into place.

(Process of deforming the deforming member 12) The following will describe a process of deforming the deforming member 12 with reference to FIG. 6.

(a) of FIG. 6 is a side view schematically illustrating the deforming member 12 before deformation, and (b) of FIG. 6 is a side view schematically illustrating the deforming member 12 after deformation. Note that although not illustrated, the key 5 is positioned on the opposite side of the restoring member 13 from the deforming member 12.

As illustrated in (a) of FIG. 6, the deforming member 12 before deformation is shaped such that the deforming member 12 is bowed outward with respect to the surfaces of the holding part of the key 5. When the user carries out the locking operation by using the key 5 to which the key accessory 11 is attached, the holding force F11 exerted toward the restoring members 13 by the locking operation is applied to the outwardly curved surface of the deforming member 12.

This causes the deforming member 12 to deform into a shape such that the deforming member 12 is bowed inward with respect to the surfaces of the holding part of the key 5, as illustrated in (b) of FIG. 6. Note that the deforming member 12 deforms such that the inwardly curved surface of the deforming member 12 after the deformation comes into contact with the inclined surfaces of the restoring members 13.

Thus, locking with use of a key to which the key accessory 11 in accordance with the present embodiment is attached deforms the deforming member 12 of the key accessory 11. Thus, by visually identifying the shape of the deforming member 12, the user can easily confirm on the spot that the user has performed locking even in a place where the user has gone out.

(Process of Restoring the Deforming Member 12)

The following will describe a process of restoring the deforming member 12 with reference to FIG. 7.

(a) of FIG. 7 is a side view schematically illustrating the deforming member 12 before restoration, and (b) of FIG. 7 is a side view schematically illustrating the deforming member 12 after restoration.

As illustrated in (a) of FIG. 7, when the user holds both ends of the arc-shaped restoring spring 15, a pressing force F12 is applied to the restoring spring 15 by the user. The restoring spring 15 transmits, to the restoring members 13, the pressing force applied by the user so that the restoring members 13 are moved toward the center of the deforming member 12. This allows the inclined surfaces of the restoring members 13 to push up the inwardly curved surface of the deforming member 12 having the inwardly bowed shape so that the deforming member 12 has the outwardly bowed shape. More specifically, the restoring members 13 apply a pushing-up force F13 to the deforming member 12. The pushing-up force F13 is a force for pushing up the inwardly curved surface of the deforming member 12 having the inwardly bowed shape via the inclined surfaces of the restoring members 13 so that the deforming member 12 has the outwardly bowed shape. This restores the deforming member 12 to its original shape before the deformation, as illustrated in (b) of FIG. 7. Further, the restoring members 13 are attached to the arc-shaped restoring spring 15 at positions between both ends of the arc-shaped restoring spring 15. Thus, when the restoring spring 15 is pressed for restoration of the shape of the deforming member 12, and the press is then stopped, the restoring spring 15 allows the restoring members 13 to return back into place.

Thus, the key accessory 11 in accordance with the present embodiment is configured such that the deforming member 12 is caused by the restoring members 13 to restore to its original shape before deformation. This allows the key accessory 11 in accordance with the present embodiment to be repeatedly used for confirmation of locking.

REFERENCE SIGNS LIST

1: Key accessory
2: Deforming member
3: Restoring member
4: Cover
5: Key
11: Key accessory
12: Deforming member
13: Restoring member
14: Cover
15: Restoring spring

The invention claimed is:

1. A key accessory to be attached to surfaces of a holding part of a key, the key accessory comprising:

a deforming member configured to be deformed into a shape by a holding force applied when a user carries out a locking operation with the key and to maintain the shape after having been deformed by the holding force to indicate that a locking operation has been performed; and a restoring member configured to cause the deforming member having the shape after the deformation to restore to its original shape before the deformation to indicate that the accessory is reset to be restored for a subsequent locking operation.

2. The key accessory according to claim 1, wherein the deforming member has a curved surface, and the deforming member before the deformation is shaped such that the deforming member is bowed outwardly with respect to the surf aces of the holding part of the key, whereas the deforming member after the deformation is shaped such that the deforming member is bowed inwardly with respect to the surfaces of the holding part of the key.

3. The key accessory according to claim 1, wherein the deforming member is a metallic member.

4. The key accessory according to claim 2, wherein the restoring member transmits, to the deforming member having the shape after the deformation, a pressing force applied by the user to cause the deforming member to restore to its original shape before the deformation.

5. The key accessory according to claim 4, wherein the restoring member is composed of a gel material and has a structure in which the pressing force applied by the user is transmitted via the gel material in a form of a force that pushes up the deforming member having an inwardly bowed shape into an outwardly bowed shape.

6. The key accessory according to claim 4, wherein the restoring member is located between the deforming member and the holding part of the key and has a structure in which the pressing force applied by the user moves the restoring member toward a center of the deforming member, thereby being transmitted to the deforming member in a form of a force that pushes up the deforming member having an inwardly bowed shape into an outwardly bowed shape.

7. The key accessory according to claim 6, further comprising:

a restoring spring which allows the restoring member to apply a force in a direction a way from the center of the deforming member.

* * * * *